US007810185B2

(12) United States Patent
Bürstner et al.

(10) Patent No.: US 7,810,185 B2
(45) Date of Patent: Oct. 12, 2010

(54) DEVICE FOR ADJUSTING AN OPERATING TABLE

(75) Inventors: Markus Bürstner, Karlsruhe (DE); Thomas Biehl, Rastatt (DE)

(73) Assignee: Maquet GmbH & Co. KGaA, Rastatt (DE)

( * ) Notice: Subject to any disclaimer, the term of this patent is extended or adjusted under 35 U.S.C. 154(b) by 655 days.

(21) Appl. No.: 11/598,596

(22) Filed: Nov. 13, 2006

(65) Prior Publication Data

US 2007/0107126 A1 May 17, 2007

(30) Foreign Application Priority Data

Nov. 14, 2005 (DE) ..... 10 2005 054 223

(51) Int. Cl.
*A61G 7/015* (2006.01)
*A61G 7/018* (2006.01)

(52) U.S. Cl. ..... 5/600; 5/613; 5/616

(58) Field of Classification Search ..... 5/600, 5/607–611, 11, 613, 616
See application file for complete search history.

(56) References Cited

U.S. PATENT DOCUMENTS

| | | | |
|---|---|---|---|
| 566,521 | A | 8/1896 | Leger |
| 1,740,906 | A | 12/1929 | Rothauszky et al. |
| 2,416,410 | A | 2/1943 | Shampaine |
| 2,763,320 | A | 9/1956 | Schram |
| 2,764,459 | A | 9/1956 | McDonald |
| 2,771,330 | A | 11/1956 | Zaalberg |
| 2,775,496 | A | 12/1956 | Berggren |
| 2,816,806 | A | 12/1957 | Zaalberg |
| 2,995,762 | A | 8/1961 | Albinson |
| 3,226,734 | A | 1/1966 | Coventon |
| 3,238,539 | A | 3/1966 | Koch |
| 3,302,218 | A | 2/1967 | Stryker |
| 3,328,079 | A | 6/1967 | Byczkowski et al. |
| 3,362,704 | A | 1/1968 | Pliz |
| 3,379,877 | A | 4/1968 | Makino et al. |
| 3,388,700 | A | 6/1968 | Mountz |
| 3,868,103 | A | 2/1975 | Pageot et al. |
| 4,101,120 | A | 7/1978 | Seshima |
| 4,176,415 | A | 12/1979 | Dickerson et al. |

(Continued)

FOREIGN PATENT DOCUMENTS

| | | |
|---|---|---|
| DE | 264297 | 8/1912 |

(Continued)

OTHER PUBLICATIONS

European Search Report for Serial No. EP 06 12 3443 dated Feb. 7, 2007.

(Continued)

*Primary Examiner*—Robert G Santos
(74) *Attorney, Agent, or Firm*—McCormick, Paulding & Huber LLP

(57) ABSTRACT

A device (24) for adjusting an operating table 10 having a column 12 on which an adjustable bed 16 is to be fastened releasably is shown. The device comprises an operating implement 26 for the input of adjustment commands for adjusting the operating table 10. The device 24 comprises means 20, 28 for the direct transmission of the adjustment commands from the operating implement 26 to the adjustable bed 16.

7 Claims, 2 Drawing Sheets

U.S. PATENT DOCUMENTS

| | | | | |
|---|---|---|---|---|
| 4,244,358 | A | 1/1981 | Pyers | |
| 4,597,119 | A | 7/1986 | Padgett | |
| 4,640,482 | A | 2/1987 | Rogers | |
| 4,768,241 | A * | 9/1988 | Beney | 5/600 |
| 5,031,547 | A | 7/1991 | Hirose | |
| 5,083,331 | A | 1/1992 | Schnelle et al. | |
| 5,220,698 | A | 6/1993 | Hannant | |
| 5,277,427 | A | 1/1994 | Bryan et al. | |
| 5,279,011 | A | 1/1994 | Schnelle | |
| 5,477,570 | A | 12/1995 | Hannant et al. | |
| 5,544,376 | A | 8/1996 | Fromson | |
| 5,564,852 | A | 10/1996 | Maxwell et al. | |
| 5,611,638 | A | 3/1997 | Dorr et al. | |
| 5,615,431 | A | 4/1997 | Vassilli | |
| 5,621,932 | A | 4/1997 | Strachan | |
| 5,628,078 | A * | 5/1997 | Pennington et al. | 5/618 |
| 5,649,833 | A | 7/1997 | Pfeuffer et al. | |
| 5,651,150 | A | 7/1997 | Kanitzer et al. | |
| 5,659,909 | A | 8/1997 | Pfeuffer et al. | |
| 5,754,997 | A | 5/1998 | Lussi et al. | |
| 5,769,720 | A | 6/1998 | Aiken et al. | |
| 5,787,528 | A | 8/1998 | Antinori | |
| 5,790,996 | A | 8/1998 | Narfstrom | |
| 5,914,796 | A | 6/1999 | Selin | |
| 5,969,488 | A | 10/1999 | Fromson | |
| 6,008,598 | A | 12/1999 | Luff et al. | |
| 6,038,718 | A * | 3/2000 | Pennington et al. | 5/618 |
| 6,073,284 | A * | 6/2000 | Borders | 5/600 |
| 6,095,713 | A | 8/2000 | Doyle et al. | |
| 6,351,678 | B1 | 2/2002 | Borders | |
| 6,390,927 | B1 | 5/2002 | Cleveland, III | |
| 6,396,224 | B1 | 5/2002 | Luff et al. | |
| 6,484,334 | B1 * | 11/2002 | Borders et al. | 5/600 |
| 6,539,028 | B1 | 3/2003 | Soh et al. | |
| 6,560,492 | B2 * | 5/2003 | Borders | 700/17 |
| 6,565,156 | B1 | 5/2003 | Yamashita et al. | |
| 6,609,260 | B2 | 8/2003 | Hand et al. | |
| 6,619,872 | B2 | 9/2003 | Crorey et al. | |
| 6,634,202 | B1 | 10/2003 | Oetiker | |
| 6,722,289 | B2 | 4/2004 | Kato | |
| 6,862,761 | B2 | 3/2005 | Hand et al. | |
| 6,971,131 | B2 | 12/2005 | Bannister | |
| 6,986,179 | B2 | 1/2006 | Varadharajulu | |
| 7,010,369 | B2 * | 3/2006 | Borders et al. | 700/90 |
| 7,068,143 | B2 | 6/2006 | Doering et al. | |
| 7,089,612 | B2 | 8/2006 | Rocher et al. | |
| 7,154,397 | B2 | 12/2006 | Zerhusen et al. | |
| 7,181,791 | B2 | 2/2007 | Clayton | |
| 7,210,201 | B2 | 5/2007 | Maekle et al. | |
| 7,235,942 | B2 | 6/2007 | Nagaoka et al. | |
| 7,321,811 | B1 | 1/2008 | Rawls-Meehan | |
| 7,346,944 | B2 | 3/2008 | Shaw | |
| 7,367,740 | B2 | 5/2008 | Lazic et al. | |
| 7,398,790 | B2 | 7/2008 | Glatz | |
| 7,412,736 | B2 * | 8/2008 | Hyre et al. | 5/613 |
| 7,526,823 | B2 | 5/2009 | Koch | |
| 7,694,366 | B2 | 4/2010 | Koch et al. | |
| 2002/0014951 | A1 | 2/2002 | Kramer et al. | |
| 2002/0111701 | A1 * | 8/2002 | Borders | 700/60 |
| 2002/0170115 | A1 | 11/2002 | Borders et al. | |
| 2003/0078144 | A1 | 4/2003 | Gehrke | |
| 2003/0090387 | A1 | 5/2003 | Lestienne et al. | |
| 2003/0195644 | A1 * | 10/2003 | Borders et al. | 700/90 |
| 2004/0006821 | A1 | 1/2004 | Hand et al. | |
| 2004/0074003 | A1 | 4/2004 | Bannister | |
| 2004/0172757 | A1 | 9/2004 | Somasundaram | |
| 2007/0056105 | A1 * | 3/2007 | Hyre et al. | 5/616 |
| 2007/0101497 | A1 | 5/2007 | Revenus | |
| 2007/0101500 | A1 | 5/2007 | Fruh et al. | |
| 2007/0107123 | A1 | 5/2007 | Koch | |
| 2007/0107124 | A1 | 5/2007 | Koch | |
| 2007/0107125 | A1 | 5/2007 | Koch | |
| 2007/0107126 | A1 | 5/2007 | Koch | |
| 2007/0107129 | A1 | 5/2007 | Burstner | |
| 2007/0110448 | A1 | 5/2007 | Ruch | |
| 2007/0116512 | A1 | 5/2007 | Katzenstein | |
| 2007/0118989 | A1 | 5/2007 | Koch | |
| 2009/0119842 | A1 | 5/2009 | Koch | |
| 2010/0107340 | A1 | 5/2010 | Koch et al. | |

FOREIGN PATENT DOCUMENTS

| | | | |
|---|---|---|---|
| DE | 4229318 | C1 | 9/1993 |
| DE | 296 10 726 | U1 | 9/1996 |
| DE | 19732467 | A1 | 2/1999 |
| DE | 197 51 320 | A1 | 5/1999 |
| DE | 19748367 | A1 | 5/1999 |
| DE | 19751329 | A1 | 5/1999 |
| DE | 19919496 | A1 | 11/2000 |
| DE | 102 53 878 | A1 | 5/2004 |
| DE | 102 53 906 | A1 | 6/2004 |
| DE | 10253906 | A1 | 6/2004 |
| EP | 0 457 246 | A1 | 11/1991 |
| EP | 0625348 | A1 | 11/1994 |
| EP | 0832603 | A1 | 4/1998 |
| EP | 0 913 139 | | 5/1999 |
| EP | 0913139 | A1 | 5/1999 |
| FR | 2388546 | | 11/1978 |
| GB | 1 321 193 | | 6/1973 |
| GB | 1321193 | | 6/1973 |
| GB | 2260075 | A | 4/1993 |
| GB | 2 277 870 | A | 11/1994 |
| WO | 99 28146 | A1 | 6/1999 |
| WO | 02 055001 | A1 | 7/2002 |
| WO | 03 086263 | A1 | 10/2003 |

OTHER PUBLICATIONS

European Search Report for Serial No. EP 06 12 3596 dated Sep. 7, 2007.

European Search Report for Serial No. EP 06 12 3592 dated Nov. 29, 2007.

European Search Report for Serial No. EP 06 12 3593 dated Dec. 4, 2007.

European Search Report for Application No. EP 06 12 3721, dated Jun. 20, 2008.

European Search Report for Serial No. EP 06 12 3598 dated Feb. 8, 2007.

European Search Report for Application No. EP 06 12 3444, dated Aug. 22, 2008.

V. Vitsas, et al., Performance Analysis of the Advanced Infrared (AIr) CSMA/CA MAC Protocol for Wireless LANs, Kluwer Academic Publishers, Wireless Networks 9, pp. 495-507, dated Sep. 2003.

European Search Report for Application No. EP 06 12 3719, dated Sep. 7, 2007.

* cited by examiner

DEVICE FOR ADJUSTING AN OPERATING TABLE

CROSS REFERENCE TO RELATED APPLICATIONS

Applicant hereby claims foreign priority benefits under U.S.C. §119 from German Patent Application No. 10 2005 054 223.9 filed on Nov. 14, 2005, the contents of which are incorporated by reference herein.

FIELD OF THE INVENTION

The present invention relates to a device for adjusting an operating table having a column on which an adjustable bed is to be fastened releasably, the device comprising an operating implement for the input of adjustment commands for adjusting the operating table.

BACKGROUND OF THE INVENTION

In known devices of the type mentioned in the introduction, the operating implement is typically a portable remote control communicating with a control unit which is arranged in the column of the operating table. The adjustment commands are transmitted to the control unit of the column, for example, via a cable, which connects the operating implement and the column, or via a device for wireless signal transmission, for example using infrared signals. Then, in response to the adjustment signals received, the control unit of the column activates the actuators of the operating table by means of which the latter is adjusted. In this case, the electronic control unit activates, on the one hand, actuators within the column, with the result that the position of the bed as a whole is adjusted, and, on the other hand, via a signal coupling between the column and the bed, actuators of the bed, with the result that the various segments of the bed are adjusted in relation to one another. When the bed is fastened on the column, both the position of the bed as a whole and the form of the bed can thereby be adjusted in many different ways, so that the patient undergoing the operation can be supported optimally.

However, the bed is not only used during the operation, but also for preoperative and postoperative transport into and out of the operating theatre. For this preoperative and postoperative bed transfer, the bed is set into a level position which is best suited for transferring a patient from and onto the bed.

In many instances, however, the level position of the bed is not ideal for medical and physiological reasons. In particular, many anaesthesias already initiated before transport into the operating theatre may make it necessary to support the patient with the upper part of the body raised, such as, for example, peridual anaesthesia. For this purpose, in many beds, special solutions are provided, whereby the bed can be adjusted, in particular, by hand even during transport. However, the adjustability achievable thereby is often unsatisfactory and makes the design of the bed more complicated.

SUMMARY OF THE INVENTION

The object on which the invention is based is to specify a device of the type mentioned in the introduction, which allows a suitable adjustment of the bed even during preoperative and postoperative bed transfer.

This object is achieved, according to the invention, in that the device has means for the direct transmission of the adjustment commands from the operating implement to the adjustable bed. In contrast to known devices, in the device according to the invention the adjustment commands can therefore be transmitted directly to the bed and do not have to follow the detour via the operating table column. As a result, the bed can be adjusted by means of the same operating implement also used in the operating theatre during the operation, even when the bed is not fastened on the column, that is to say, in particular, during preoperative and postoperative transport. The same functions for adjusting the bed which are used during the operation and with which the user is familiar are thus available even during the bed transfer. Since the user can adjust the bed, during transfer, by means of the same operating implement familiar to him from use during the operation, operation is simplified for the user. At the same time, there is no longer any need for additional adjustment possibilities which are provided, extra, for the bed transfer.

Preferably, the means for the direct transmission of the adjustment commands are formed by a cable, of which one end is connected or connectable to the operating implement and the other end is connected or connectable to the bed. Preferably, in this case, the cable can be plugged in on the bed via a plug connection.

A cable connection between the operating implement and the bed is particularly advantageous, since it is less susceptible to external interference than a wireless connection. This is important particularly because, outside the operating theatre, there may be a multiplicity of interference sources for wireless signal transmission which cannot readily be eliminated.

The cable-bound transmission of the adjustment commands from the operating implement to the operating table affords a further advantage in that the adjustment commands are transmitted directly to the bed, that is to say the cable is plugged in on the bed, not on the column, as has been customary hitherto. This is because, in practice, the operating implement is often suspended on the bed during the operation. When the bed is then released from the column after the operation and the bed, together with the patient supported on it, is transported out of the operating theatre, it easily happens that the operating implement is inadvertently left hanging on the bed, so that the cable, the other end of which is plugged in the column, is tensioned when the bed is transported away and, if the mistake is not noticed in good time, may be damaged.

In an advantageous development, however, the column has arranged on it, in addition, a plug connection element, on which the cable of the operating implement can be plugged in via a plug connection. In this development, therefore, the operating implement can be plugged in selectively on the bed or on the column.

This has, inter alia, the following advantage: when the cable of the operating implement is plugged in the bed, the adjustment commands for adjusting the segments of the bed in relation to one another are transmitted to the actuators of the bed, and the adjustment commands for adjusting the column-side actuators are transmitted to the column via a signal coupling. However, not necessarily all beds used in conjunction with the operating table column are equipped with all the adjustment functions. In particular, beds may also be used which cannot be adjusted per se at all. If the operating implement were not additionally also capable of being plugged in on the column, even such simple beds would have to have an input for the cable of the operating implement, in order to transmit the adjustment commands to the operating table column via the bed and the signal coupling. The bed would consequently become more complicated in its construction than it would have to be in terms of its function.

Instead, it is advantageous to arrange on the operating table column a further plug connection element on which the cable of the operating implement can be plugged in, so that the adjustment commands relating to the operating table column can be input directly into the column and do not necessarily have to follow the detour via the bed. Moreover, as a result, beds which are already in stock and on which the cable of the operating implement cannot be plugged in can continue to be used in the same system.

Instead of the cable, the means for the direct transmission of the adjustment commands may also be formed by means for wireless signal transmission, in particular for the transmission of infrared signals. Then, advantageously, for the abovementioned reasons, an infrared receiver is also arranged on the column in addition to an infrared receiver in the bed.

The adjustment of the operating table preferably comprises an adjustment of segments of the bed in relation to one another and, in addition, one or more of the following adjustments of the bed as a whole: a height adjustment of the bed, a rotation of the bed about a vertical axis, a tilting of the bed about its transverse axis, a tilting of the bed about its longitudinal axis and a translation of the bed in its longitudinal direction.

Preferably, the bed comprises a first electronic control unit which has an input for adjustment commands and which is programmed such that, from the adjustment commands received via the input, it generates control signals for the actuators for adjusting the operating table.

Preferably, in the operating table column, a second electronic control unit is provided, which has an input for adjustment commands and which is programmed such that, from the adjustment commands received via its input, it generates control signals for actuators for adjusting the operating table.

Preferably, the bed has electrically driven actuators for adjusting its segments in relation to one another and an electrical connection for a mobile voltage source. The mobile voltage source can then provide the electrical voltage for actuating the actuators during preoperative and postoperative bed transfer.

The invention relates, furthermore, to an operating system comprising an adjustable operating table having a column on which an adjustable bed is to be fastened releasably, a device for adjusting the operating table according to one of the developments described above and a trolley which is suitable for transporting the bed together with a patient supported on it, the trolley comprising a voltage source which is suitable for supplying the actuators of the bed with voltage.

Preferably, in the operating system, furthermore, the bed and the column can be connected simultaneously both mechanically and electrically via a column coupling, and, on the trolley, a coupling part is provided which can be coupled mechanically and electrically to a bed-side coupling part of the column coupling. The bed can thereby be fastened to the trolley for preoperative and postoperative transfer in the same way as it is fastened to the operating table column for the operation, and, in particular, the electrical power supply for the actuators of the bed is automatically co-connected.

BRIEF DESCRIPTION OF THE DRAWINGS

For a clearer understanding of the present invention, reference is made below to the preferred exemplary embodiment which is illustrated in the drawings and which is described by means of specific terminology. It may be pointed out, however, that the scope of protection of the invention is not to be restricted thereby, since such variations and further modifications to the device shown and such further applications of the invention as are indicated in it are considered to be the conventional current and future specialized knowledge of a competent person skilled in the art. An exemplary embodiment of the invention is shown in the figures in which, to be precise.

DETAILED DESCRIPTION OF THE INVENTION

Figure 1:
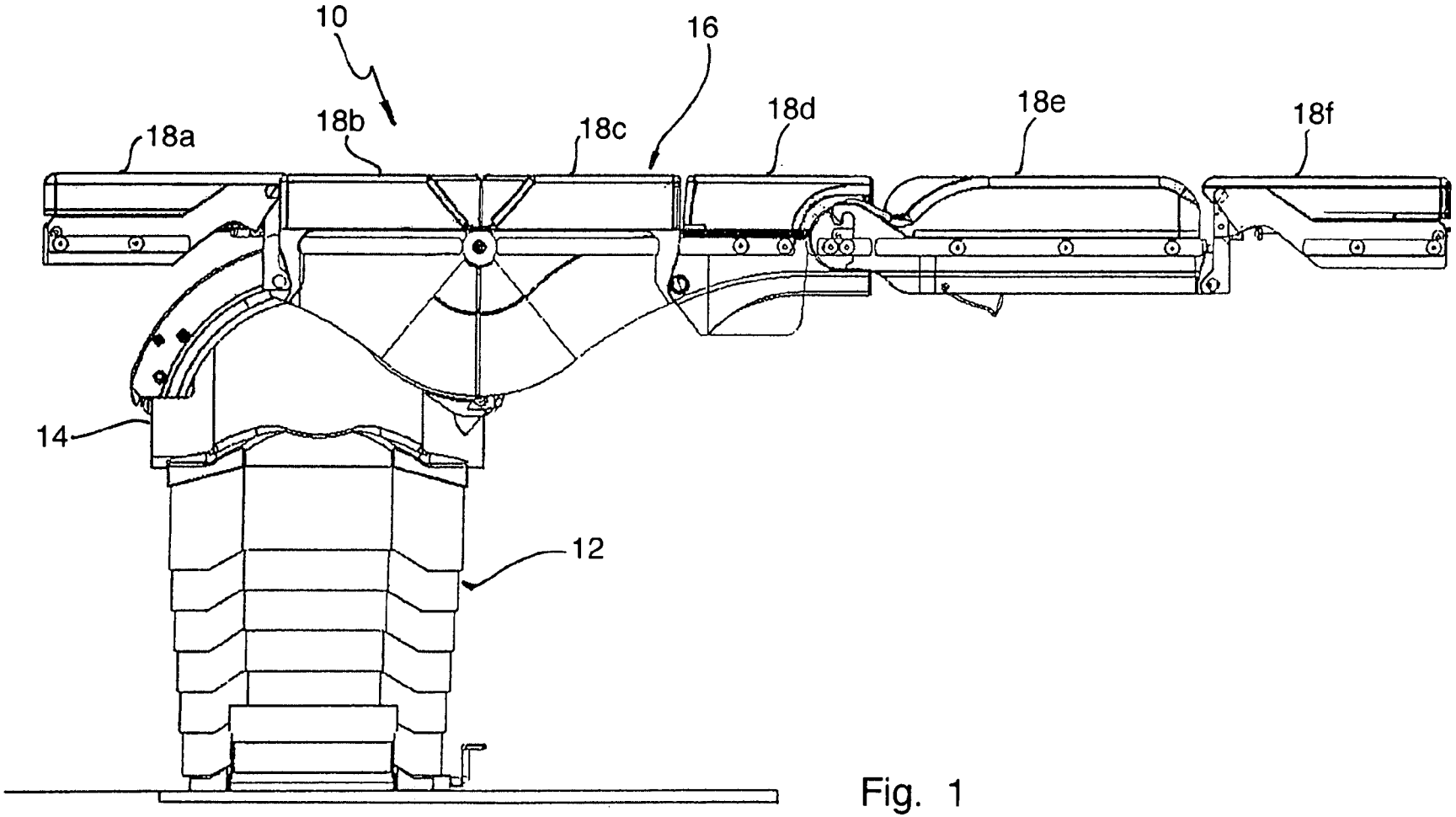
FIG. 1 shows a side view of an operating table.

FIG. 1 illustrates a side view of an operating table 10 which is adjustable by means of a device according to a development of the invention. The operating table 10 comprises a column 12 with a column head 14 to which a bed 16 is fastened releasably. The bed 16 comprises six segments 18*a* to 18*f* which are adjustable in relation to one another. On the bed 16, a socket 20 is provided, into which a cable of an operating implement (not shown in FIG. 1) can be plugged by means of an associated plug. An identical socket 22 is also arranged on the column head 14.

Figure 2:
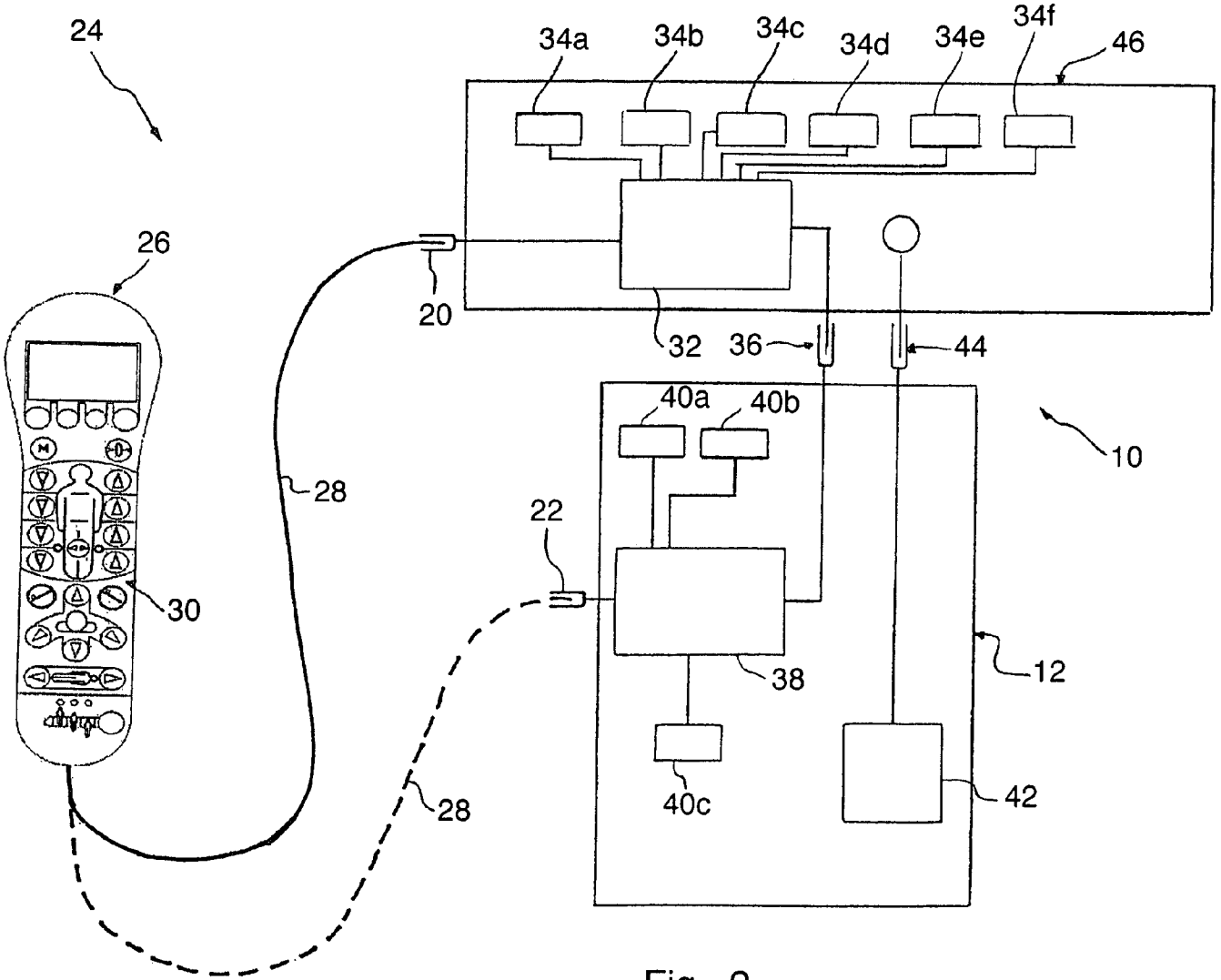
FIG. 2 shows a block diagram in which the operating table and an operating implement are illustrated diagrammatically.

In the operating table 10 of FIG. 1, a device 24 for adjusting the latter according to a development of the invention is provided, which is illustrated in a block diagram in FIG. 2.

The column 12 and the bed 16 are illustrated diagrammatically in the block diagram of FIG. 2. The device 24 comprises, furthermore, an operating implement 26, to which is fastened a cable 28 which is plugged into the socket 20 of the bed 16 in FIG. 2. Alternatively, in the development of the device 24 of FIG. 2, the cable 28 can also be plugged into the socket 22 of the column 12, this being indicated by the dashed illustration of the cable 28 in FIG. 2. The instance in which the cable 28 is plugged into the socket 22 of the column 12 is described separately below.

The operating implement 26 has an operating face 30 on which a plurality of buttons or keys are provided. Adjustment commands for adjusting the operating table 10 can be input via these buttons or keys.

The adjustment commands input into the operating implement 26 are input via the cable 28 and the socket 20 into a first electronic control unit 32 which is contained in the bed 16. In response to the adjustment commands from the operating implement 26, the electronic control unit 32 activates actuators 34*a* to 34*f*, by means of which the segments 18*a* to 18*f* (see FIG. 1) can be adjusted in relation to one another. Furthermore, the first electronic control unit 32 sends control signals, via a signal coupling 36 provided between the column 12 and the bed 16, to a second electronic control unit 38 which is provided in the column 12. These control signals represent, inter alia, the adjustment commands relating to an adjustment of the column 12 of the column head 14. These are, in particular, commands by means of which the bed 16 as a whole is adjusted, and, in the exemplary embodiment shown, they relate to a height adjustment of the bed 16, a rotation of the bed 16 about a vertical axis, a tilting of the bed 16 about its transverse or longitudinal axis and a translation of the bed 16 in its longitudinal direction. In order to carry out this adjustment, the second electronic control unit 38 activates suitable actuators 40*a* to 40*c* of the column 12.

Furthermore, in the column 12, a voltage source 42 is provided, via which the actuators 40*a* to 40*c* of the column 12 are supplied with voltage. When the bed 16 is fastened on the column head 14 of the column 12 via a column coupling, not described in any more detail here, in addition to a mechanical connection and the closing of the signal coupling 36 an electrical plug connection 44 is closed, via which the bed 16 is connected to the voltage source 42 of the column 12. The electrical voltage for operating the actuators 34*a* to 34*f* of the bed 16 is thereby provided.

When the bed 16 is separated from the column 12 after the operation in order to transport a patient supported on it out of the operating theatre, the operating implement 26 can be left with its cable 28 plugged in the socket 20. The bed 16 is fastened on a trolley (not shown) which comprises a mobile voltage source. When the bed 16 is being fastened on the trolley, the bed-side part of the electrical plug connection 44 makes a plug connection to a connector of the trolley, via which plug connection the bed 16 on the trolley is supplied with voltage by the mobile voltage source of the latter. The actuators 34*a* to 34*f* can consequently be actuated even when the bed 16 is fastened on the trolley. The bed 16 on the trolley can thus be adjusted by means of the same operating implement 26 as during the operation. On account of this, all the adjustment functions of the bed 16 are basically available even during the preoperative and postoperative transfer of the bed 16, with the result that the patient can be supported optimally.

In conventional operating tables, the operating implement cannot be plugged in the bed, but only in the column, for example via a socket similar to the socket 22 of the column 12 of FIG. 2. During the operation, the operating implement 26 is often suspended on the bed 16. If, in conventional systems, the operating implement is inadvertently suspended on the bed and left plugged in on the column, the connecting cable may be damaged during an attempt to transport the bed out of the operating theatre. In the device 24 of FIG. 2, this risk is eliminated in that the cable 28 is regularly plugged in the socket 20 of the bed 16.

Nevertheless, in the device 24 of FIG. 2, a socket 22 on the column is additionally provided, in which the cable 28 of the operating implement 26 can be plugged. The additional socket 22 on the column 12 is advantageous when simpler beds than the bed 16 shown in FIGS. 1 and 2 are used, which per se are adjustable only slightly or not at all. In simple beds of this type, it would be highly complicated to provide, extra, an input for the adjustment commands solely in order then to transmit them into the column 12 via the bed so as to activate the actuators 40*a* to 40*c* of the column 12. In such instances, it is simpler to plug in the cable 28 of the operating implement 26 directly via the socket 22 of the column 12.

Although FIG. 2 shows a cable 28 for transmitting the adjustment commands from the operating implement 26 to the bed 16 or the column 12, transmission may also take place wirelessly, for example via infrared signals.

Although the drawings and the above description have shown and described in detail a preferred exemplary embodiment, this should be considered as purely illustrative and not restrictive of the invention. It is pointed out that only the preferred exemplary embodiment is illustrated and described, and all variations and modifications which come at the present time and in future within the scope of protection of the invention are to be protected.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A device for adjusting an operating table having a column on which an adjustable bed is to be fastened releasably, the device comprising an operating implement for the input of adjustment commands for adjusting the operating table and a cable for direct transmission of the adjustment commands from the operating implement to the adjustable bed, wherein a first end of the cable is connected or connectable to the operating implement and in a first configuration, a second end of the cable can be plugged into a first plug connection on the bed, and in a second configuration, the second end of the cable can be plugged into a second plug connection on the column.

2. The device according to claim 1, the adjustment of the operating table comprising an adjustment of segments of the bed in relation to one another and, in addition, one or more of the following adjustments of the bed as a whole: a height adjustment of the bed, a rotation of the bed about a vertical axis, a tilting of the bed about its transverse axis, a tilting of the bed about its longitudinal axis and a translation of the bed in its longitudinal direction.

3. The device according to claim 1, in which the bed comprises a first electronic control unit which has an input for adjustment commands and which is programmed such that, from the adjustment commands received via the input, it generates control signals for actuators for adjusting the operating table.

4. The device according to claim 1, in which, in the column, a second electronic control unit is provided, which has an input for adjustment commands and which is programmed such that, from the adjustment commands received via the input, it generates control signals for actuators for adjusting the operating table.

5. The device according to claim 1, in which the bed has electrically driven actuators for adjusting its segments in relation to one another and an electrical connection for a mobile voltage source.

6. An operating table system comprising:

an adjustable operating table with a column on which an adjustable bed is to be fastened releasably, the bed having mutually adjustable segments and having electrically driven actuators for adjusting the adjustable segments in relation to one another and further having an electrical voltage connection for a mobile voltage source; and a trolley which is suitable for transporting the bed together with a patient supported on it, the trolley comprising a voltage source which is suitable for supplying the actuators of the bed with voltage.

7. The operating table system according to claim 6, in which the bed and the column can be connected simultaneously both mechanically and electrically via a column coupling, and in which, on the trolley, a coupling part is provided which can be coupled mechanically and electrically to the bed-side coupling part of the column coupling.

* * * * *